United States Patent [19]

Stollberg

[11] 4,176,745

[45] Dec. 4, 1979

[54] SHIPPING CONTAINER

[75] Inventor: Ray H. Stollberg, Gilroy, Calif.

[73] Assignee: Crown Zellerbach Corporation, San Francisco, Calif.

[21] Appl. No.: 955,815

[22] Filed: Oct. 30, 1978

Related U.S. Application Data

[63] Continuation-in-part of Ser. No. 906,190, May 15, 1978.

[51] Int. Cl.[2] ..... B65D 85/50

[52] U.S. Cl. ..... 206/423; 217/42; 220/367

[58] Field of Search ..... 206/423, 45.26; 229/6 A; 220/367; 217/42

[56] References Cited

U.S. PATENT DOCUMENTS

| | | | |
|---|---|---|---|
| 236,089 | 12/1880 | Roberts | 217/42 |
| 1,993,383 | 3/1935 | Rossi | 206/45.26 |
| 2,345,000 | 3/1944 | Newsom | 229/6 A |
| 2,830,405 | 4/1958 | Nydegger | 206/423 |
| 3,863,829 | 2/1975 | Merrill | 206/423 |

FOREIGN PATENT DOCUMENTS

| | | | |
|---|---|---|---|
| 2256662 | 7/1975 | France | 206/423 |

*Primary Examiner*—Herbert F. Ross
*Attorney, Agent, or Firm*—Thomas R. Lampe

[57] ABSTRACT

A shipping container for cut flowers or the like comprising a tray and a cover for placement on the tray. Apertures are formed in the tray and cover which are in registry when the cover is placed on the tray to provide communication between the interior of the shipping container and ambient atmosphere. Closure flaps are provided in the cover and tray for selective placement over the apertures. The closure flaps are hinged so that they may be quickly manually opened and cooperate when opened to lock in open position.

6 Claims, 6 Drawing Figures

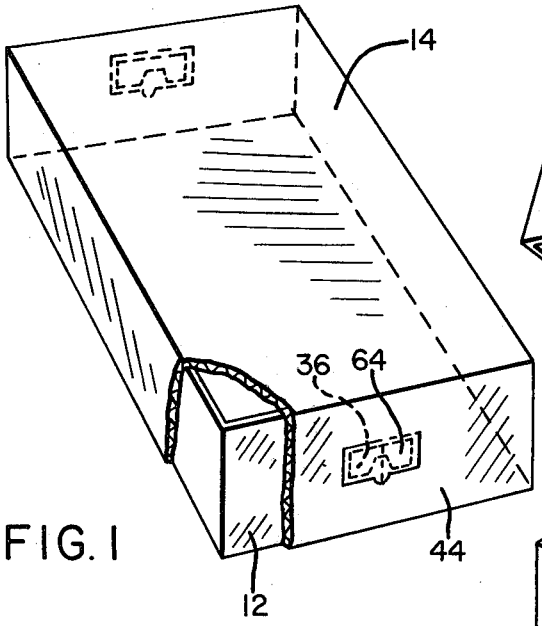
FIG. 1
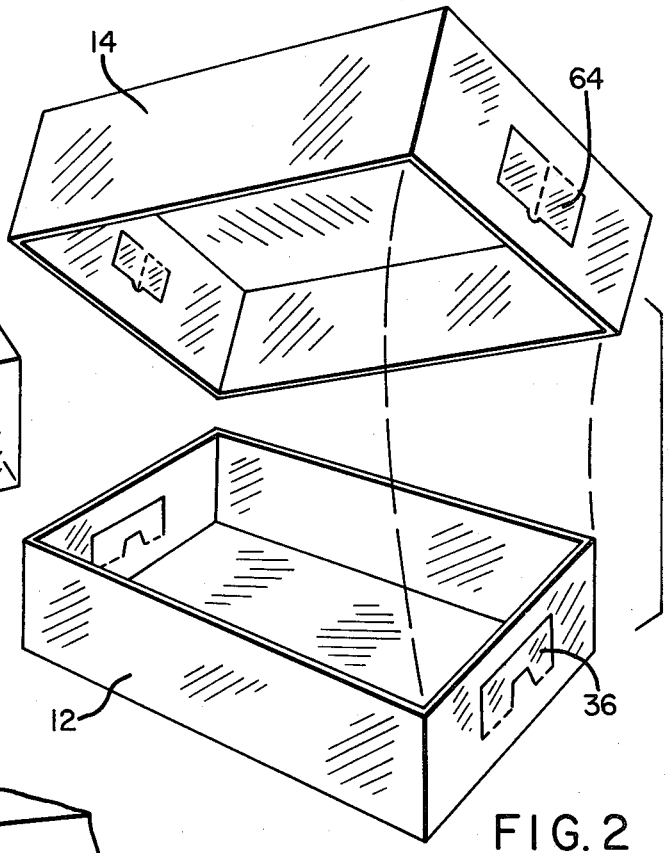
FIG. 2
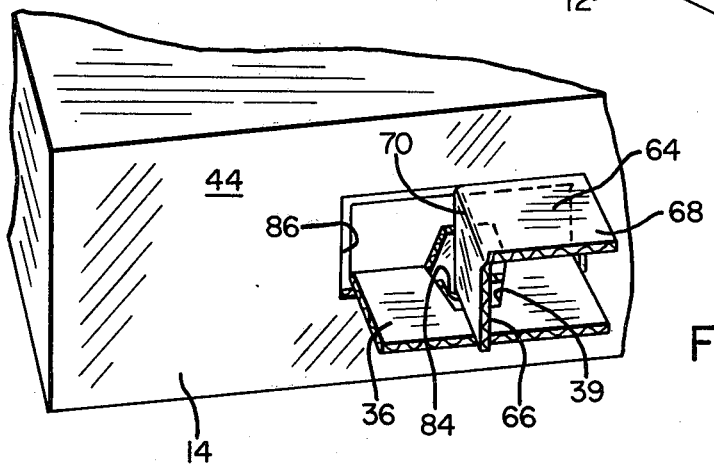
FIG. 3
FIG. 4
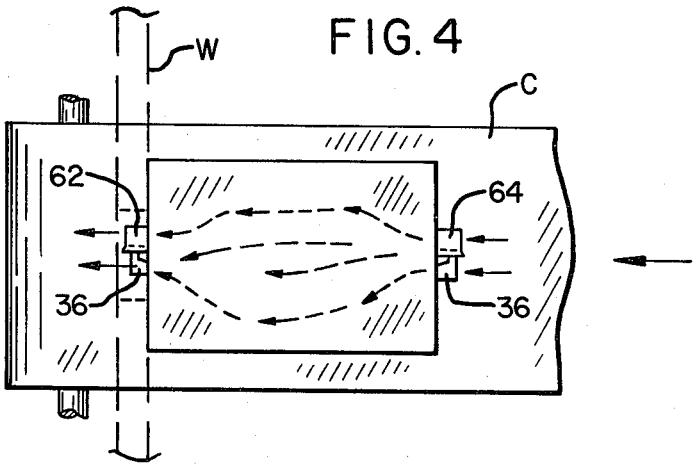

SHIPPING CONTAINER

The instant application is a continuation-in-part of Applicant's co-pending application Ser. No. 906,190, filed May 15, 1978.

BACKGROUND OF THE INVENTION

It has been a long-standing practice in the floral industry to pre-cool cut flowers for shipment in order to prolong their freshness. Pre-cooling has customarily been done by packing the cut flowers into large corrugated trays and then storing them in refrigerated warehouses until the heat was dissipated out of the flowers. This retarded the natural deterioration that takes place after the flowers are cut. A recent development has been to force-cool the cut flowers by utilizing a vacuum to suck out the warm moist air from the flowers and draw into the shipping container the low temperature ambient air in a refrigerated warehouse. It has been found that this process retards deterioration of the cut flowers for an even longer period than the afore-described conventional cooling process. The container disclosed in copending application Serial No. 906,190 was developed for use in the vacuum cooling process and incorporates a closure means associated with the container cover that may readily be opened for vacuum cooling and then quickly manually closed to maintain the interior of the shipping container in a low temperature condition. The present invention is directed to a shipping container featuring an improved closure. In the container of application Ser. No. 906,190 the closure communicated with apertures formed in the container tray. This arrangement has led to some of the cold air in the container migrating between the side walls of the tray and the cover even with the closure shut, thus reducing the container's effectiveness.

SUMMARY OF THE INVENTION

According to the present invention, a shipping container for cut flowers and the like is provided which is of simple and economical construction but also incorporates a closure arrangement that readily adapts itself to the vacuum cooling process, and in particular, to being quickly manually opened so that a vacuum may be applied to the interior of the container to draw cooled air therein and just as quickly closed to retain the cooled air in the container after the forced cooling operation has been terminated. The closure includes two closure flap components in registry when the container is assembled, one of which is associated with the tray side wall to prevent migration of cold air from the tray interiors through the tray apertures, and the other associated with the corresponding cover side wall.

In particular, the shipping container for cut flowers and the like comprises a tray having a bottom wall and a plurality of tray side walls extending from the bottom wall, at least one of the tray side walls having an aperture formed therein. A cover is provided for placement on the tray, including a top wall and depending cover side walls, at least one of the cover side walls having an aperture formed therein, said apertures being in registry when the cover is placed on the tray. The container additionally includes closure means. The closure means comprises a closure flap formed of generally rectangular configuration formed in the cover and a closure flap formed in the tray to register with the cover closure flap when the cover is positioned on the tray. The cover closure flap is comprised of first and second adjacent flap segments hingedly secured to one another with one of said segments being hingedly secured to the cover. The flap segments are foldable about their common hinge line and about a hinge line securing the one flap segment to the cover. The tray closure flap is comprised of a single inverted generally U-shaped flap segment hingedly secured to the tray side wall and defining a notch. When the tray closure flap is swung outwardly and downwardly the notch is adapted to receive the first flap segment of the cover closure flap and both closure flaps are maintained in engagement in an open condition.

Other objects will be apparent from the following more detailed description and accompanying drawings in which:

DESCRIPTION OF DRAWINGS

FIG. 1 is an isometric view of the shipping container hereof in fully assembled and set-up condition with a portion of the cover of the box partially broken away;

FIG. 2 is an exploded isometric view showing the cover portion of the shipping container just prior to its placement over the tray portion thereof;

FIG. 3 is an enlarged isometric view showing a portion of one end of the shipping container of the present invention and showing details of the closure means;

FIG. 4 is a plan view illustrating schematically how a container is utilized during the force cooling operation.

DETAILED DESCRIPTION

Figure 5:
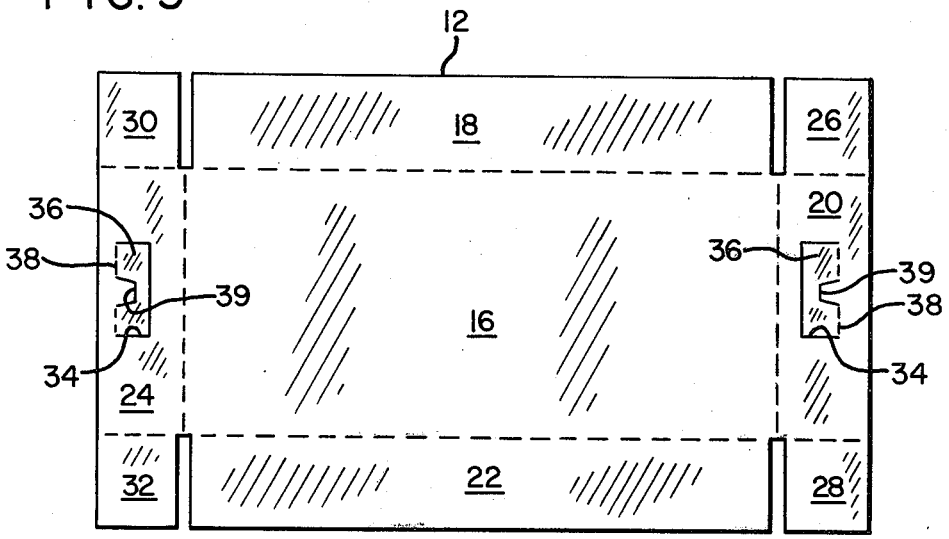
FIGS. 5 and 6 are plan views illustrating the tray and cover blanks, respectively, from which the shipping container is constructed.

Referring now to FIGS. 1 and 2, a shipping container constructed according to the teachings of the present invention is illustrated and comprises a tray component 12 and a cover component 14 adapted for placement over the tray, said components preferably being made of corrugated paper board. Tray 12 is constructed from a one-piece blank illustrated in FIG. 5 and includes a bottom wall 16 and a plurality of tray side walls 18, 20, 22, and 24 connected to the bottom wall 16 along fold lines. When constructing the tray the side walls are formed at right angles to the bottom wall and flaps 25, 28, 30 and 32 which are connected to side walls 20 and 24 are brought into face to face relationship with side walls 18 and 22 and secured thereto in any desirable fashion such as gluing or stapling so that the blank assumes a permanent tray configuration. Side walls 20 and 24 are die cut to provide apertures 34 therein. Each aperture 34 is defined and normally closed by a closure flap in the form of an inverted generally U-shaped flap segment 36 hingedly secured to its associated tray side wall along hinge line 38. Each hinge line 38 is interrupted as shown by a slit defining a notch 39 in the tray closure flap.

Figure 6:
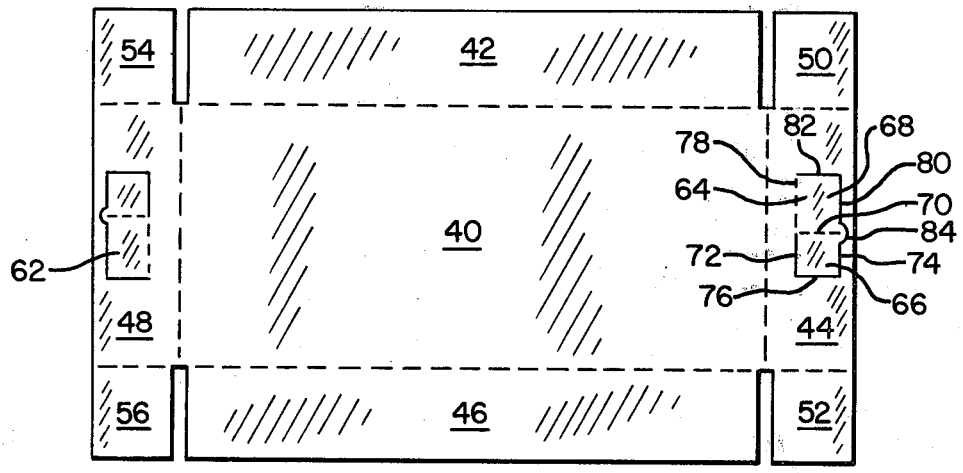

Referring now to FIG. 5, the blank used to construct the cover 14 is illustrated and includes a top wall 40 and cover side walls 42, 44, 46 and 48 connected thereto along fold lines. To assemble the cover, the cover side walls are positioned at right angles to the top wall and secured in such position by means of flaps 50, 52, 54 and 56 depending from cover side walls 44 and 48. Again, any suitable expedient such as glue, staples, etc. may be employed to secure the flaps to side walls 42 and 46. Closure flaps 62 and 64 are integrally formed in their respective side walls 48 and 44. The closure flaps 62 and 64 are of identical construction and details thereof will be described with particular reference to closure flap 64. In addition to FIG. 6, reference is also made to FIG. 3 for details of the closure flap construction. Closure flap 64 is of generally rectangular configuration and is comprised of first and second adjacent flap segments 66 and 68 hingedly secured to one another along a first hinge line 70. First flap segment 66 is defined by the first hinge line, first and second lines of cut 72 and 74 formed in the cover extending from the opposed ends of the first hinge line and a third line of cut 76 formed in the cover interconnecting the first and second lines of cut and spaced from the first hinge line. The second flap segment is defined by the first hinge line 70, a second hinge line 78 between the closure flap and the remainder of the cover and extending substantially at right angles to the first hinge line from one end thereof, a fourth line of cut 80 formed in the cover and extending from the other end of the first hinge line and a fifth line of cut 82 formed in the cover and extending between the fourth line of cut 80 and the second hinge line 78 and spaced from the first hinge line 70. The second and fourth lines of cut 74 and 80 are connected and form a notch 84 in the cover in communication with the aperture 86 that is formed in the cover when the closure flap 62 is opened.

The shipping container of the present invention functions as follows. First, the tray 12 is filled with the desired contents such as cut flowers, and the cover is then placed over the tray and its contents so that the tray and cover assume the respective positions illustrated in FIG. 1. It will be noted that when the tray and cover are in such position the aperture 86 formed in cover side wall 44 is in registry with the aperture 34 formed in the tray side wall 20. In FIG. 1, the closure flaps 36 and 64 are illustrated as being in a closed position wherein communication between the interior of the shipping container and ambient atmosphere is interrupted. When it is desired to vacuum-cool the contents of the shipping container, a step that normally occurs almost immediately after packing of the container with its contents, the closure flap 64 is manually pulled open to a generally longitudinal position. The operator then pulls the tray closure flap 36 outwardly and downwardly about hinge line 38. The first flap segment 66 of the cover closure flap is then manually manipulated downwardly about hinge line 70 so that it is positioned in cover notch 84 as well as in notch 39 of the tray closure flap. The tray and cover closure flaps are thus maintained open and communication is established through apertures 34 and 86 as shown in FIG. 3.

It will be appreciated that closure flaps 62 and 36 formed in the opposed side of the container are similarly manually opened and positioned. With the closure flaps open, the interior of the box is cooled. FIG. 4 illustrates in schematic fashion one suitable approach for doing this. Assuming that the container is in a refrigerated room the container is brought into abutting engagement with a room wall W having an aperture A formed therein. Delivery of the container may be effected by a suitable conveyor C. The apertures associated with the closure flaps are in alignment with aperture A and a vacuum is applied to the opposite side of wall W to withdraw air from the interior of the container and draw cool air into the container at the other end thereof. After sufficient cooled air has been delivered into the interior of the container the container is removed from engagement with wall W and the closure flaps are quickly and easily manually manipulated into their closed positions. This may be done simply with respect to closure flap 64 for example by bending flap segment 64 slightly upwardly so that the bottom of flap segment 66 will clear notch 84 and notch 39 of the tray closure flap 36. Flap segment 66 is then brought into planar alignment with flap segment 64 and tray closure flap 36 is pushed back into a closed position. Cover closure flap 64 is then closed. Frictional engagement between the closure flaps and the surrounding tray and cover structure will serve to retain the closure flaps closed during shipment. If a more substantial closure is desired, a piece of tape or label can be applied over the cover closure flap.

I claim:

1. A shipping container for cut flowers and the like comprising:

a tray including a bottom wall and a plurality of tray side walls extending from said bottom wall, at least one of said tray side walls having an aperture formed therein and a tray closure flap manually movable between an open and closed position relative to said aperture;

a cover for placement on said tray, said cover including a top wall and depending cover side walls, at least one of said cover side walls having an aperture formed therein, said apertures being in registry when said cover is placed on said tray, said cover additionally including a cover closure flap manually movable between an open and a closed position relative to said cover aperture; and lock means on said cover closure flap for selectively retaining both said tray and cover closure flaps in open position.

2. The container of claim 1 wherein said cover closure flap is of generally rectangular configuration and is comprised of first and second adjacent flap segments hingedly secured to one another along a first hinge line, the first flap segment being defined by said first hinge line, first and second lines of cut formed in said cover extending from opposed ends of said first hinge line and a third line of cut formed in said cover interconnecting said first and second lines of cut and spaced from said first hinge line, the second flap segment being defined by said first hinge line, a second hinge line between said flap and said cover and extending substantially at right angles to said first hinge line from one end thereof, a fourth line of cut formed in said cover extending from the other end of said first hinge line and a fifth line of cut formed in said cover extending between said fourth line of cut and said second hinge line and spaced from said first hinge line.

3. The container of claim 2 wherein said second and fourth lines of cut are connected and form a notch in the cover in communication with said cover side wall aperture, said cover notch adapted to receive said first flap segment therein to maintain said cover flap in open position.

4. The container of claim 3 wherein said tray closure flap has a notch formed therein, said tray closure flap notch adapted to receive said cover flap first portion therein when said cover flap first portion is positioned in said cover notch and said tray closure flap is in open position.

5. The container of claim 1 wherein said tray closure flap is in the form of a generally U-shaped flap segment hingedly secured to its associated tray side wall.

6. The container of claim 1 wherein said tray closure flap is adapted to project through the cover side wall when said tray closure flap is open.

* * * * *